United States Patent [19]

Keintzel et al.

[11] Patent Number: 4,576,125

[45] Date of Patent: Mar. 18, 1986

[54] WATER SEPARATOR FOR DRYING WET VAPOR, WITH SUBSEQUENT SUPERHEATING OF THE DRIED VAPOR

[75] Inventors: Günter Keintzel; Klaus Westebbe, both of Gummersbach, Fed. Rep. of Germany

[73] Assignee: L. & C. Steinmüller GmbH, Gummersbach, Fed. Rep. of Germany

[21] Appl. No.: 586,008

[22] Filed: Mar. 2, 1984

[30] Foreign Application Priority Data

Mar. 1, 1983 [DE] Fed. Rep. of Germany .... 3307101

[51] Int. Cl.[4] ..... F23G 1/00

[52] U.S. Cl. ..... 122/483; 55/440; 55/443; 122/491

[58] Field of Search ..... 122/491, 483, 492; 55/440, 443

[56] References Cited

U.S. PATENT DOCUMENTS 3,950,156 4/1976 Kall ..... 55/440
4,273,077 6/1981 Bessouat et al. ..... 122/483

FOREIGN PATENT DOCUMENTS 2628786 12/1977 Fed. Rep. of Germany ..... 122/483
2933325 2/1981 Fed. Rep. of Germany ..... 122/483

*Primary Examiner*—Edward G. Favors
*Attorney, Agent, or Firm*—Becker & Becker, Inc.

[57] ABSTRACT

A tank containing a water separator composed of bundles of laminations for drying wet vapor, and a superheater for subsequent superheating of the dried vapor. The water separator is coaxially disposed ahead of the superheater in the horizontal-cylindrical tank, which has at least one vapor inlet and one vapor outlet. The superheater includes tube bundles which are uniformly disposed about the central axis of the tank, and can vary in number and type of construction. In the direction of the central axis of the tank, the water separator has the shape of a truncated pyramid or cone. The vapor discharge surfaces of the bundles of laminations, within the water separator, are disposed symmetrically, vertically, and in tiers relative to the central axis of the tank, and are disposed at an angle of between 10° and 170° thereto.

1 Claim, 5 Drawing Figures

WATER SEPARATOR FOR DRYING WET VAPOR, WITH SUBSEQUENT SUPERHEATING OF THE DRIED VAPOR

BACKGROUND OF THE INVENTION

1. Field of the Invention

The present invention relates to a water separator, which comprises bundles of laminations, for drying wet vapor, with subsequent superheating of the dried vapor. The water separator is coaxially disposed ahead of a superheater in a horizontal, cylindrical tank which has at least one vapor inlet and one vapor outlet. The superheater comprises tube bundles which are uniformly disposed about the central axis of the tank, and can vary in number and type of construction. In the direction of the central axis of the tank, the water separator has the shape of a truncated pyramid or cone.

2. Description of the Prior Art

Water separators of bundles of laminations for drying wet vapor, and the subsequent superheating of the dried vapor, is known. With one heretofore known type of construction, the water separator elements and the superheater elements are concentrically disposed over the entire length of the common horizontal tank. Procedural drawbacks arise with this arrangement to the extent that the wet vapor must be guided over the entire length of the tank, thus giving rise to the danger of corrosion along the inner surface of the tank walls. This drawback can only be prevented by the expensive procedure of plating the inner surface of the pressure wall, or by the utilization of a high-grade material. Due to the concentric arrangement, and as a result of localized temperature differences, the tank wall is nonuniformly thermally stressed, which, among other things, makes it necessary to install expensive and complicated sealing arrangements.

Further criteria are the factors that the length of the superheater elements also directly affects the length of the separator, and that the arrangement of the water separator and the superheater in the horizontal, cylindrical tank also will involve different structural requirements than do those in vertical tanks.

These problems are mainly avoided or taken into account with a successive arrangement in the direction of the central axis of the tank.

Pursuant to the disclosure of German Offenlegungsschrift No. 2933325.3, the bundles of lamination of the water separator are disposed in a horizontal tank in such a way that the wet vapor is no longer guided along the wall of the tank. The arrangement of the individual bundles is such that the crossectional area of entry, as viewed in the direction of flow, decreases toward the back bundles. Thus, a preliminary distribution and an equalization on the entry side, and an open exit cross-sectional area toward the back, is realized. The speed of the vapor ahead of and after the separator remains nearly constant, and the pressure loss is reduced.

German Offenlegungsschrift No. 2901272.4 discloses guiding the wet vapor into a chamber which is enclosed on all sides, with the side walls, and possibly also the end wall, preferably comprising aligned bundles of angular laminations which are disposed parallel to one another and which can additionally be provided with collecting troughs.

A combination of the aforementioned arrangements is described in U.S. Pat. No. 3,923,010-Chlique, dated December 2, 1975. According to this patent, the wet vapor enters a chamber which tapers in the manner of a wedge, with aligned separator elements being disposed in the wedge surfaces.

A drawback to this type of construction is that with a view toward avoiding corrosion damage on the tank wall due to incompletely dried vapor, or with a view toward a high degree of separation in the water separator at the predetermined diameter in conjunction with the elements of the subsequent superheater, an uneconomical and unfavorable structure and length of the separator and of the tank result.

An object of the present invention therefore is to arrange the bundles of laminations of the water separator of the aforementioned general type in such a way that a high degree of separation is achieved due to uniform exposure of the bundles of laminations of the water separator with wet vapor, and that an economical, favorable structure and an overall very high energy efficiency is achieved in conjunction with the subsequent tube elements of the superheater.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
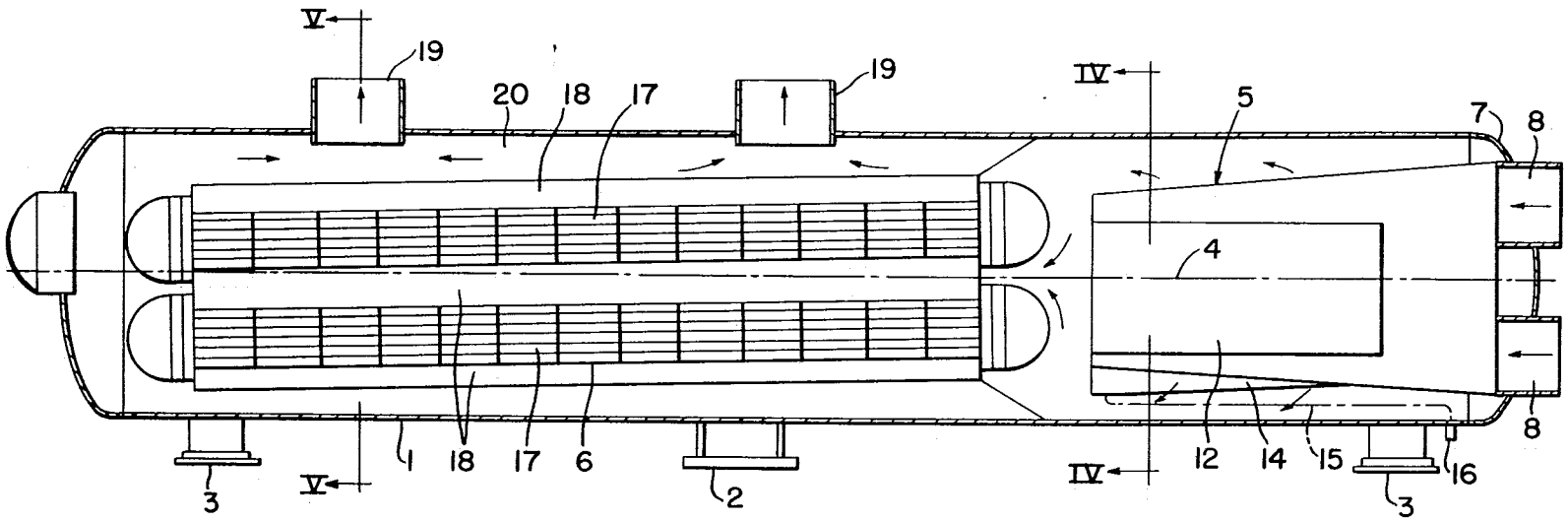
FIG. 1 is a vertical longitudinal section schematically illustrating one inventive embodiment of the horizontal tank which contains the water separator and the superheater.
Figure 2:
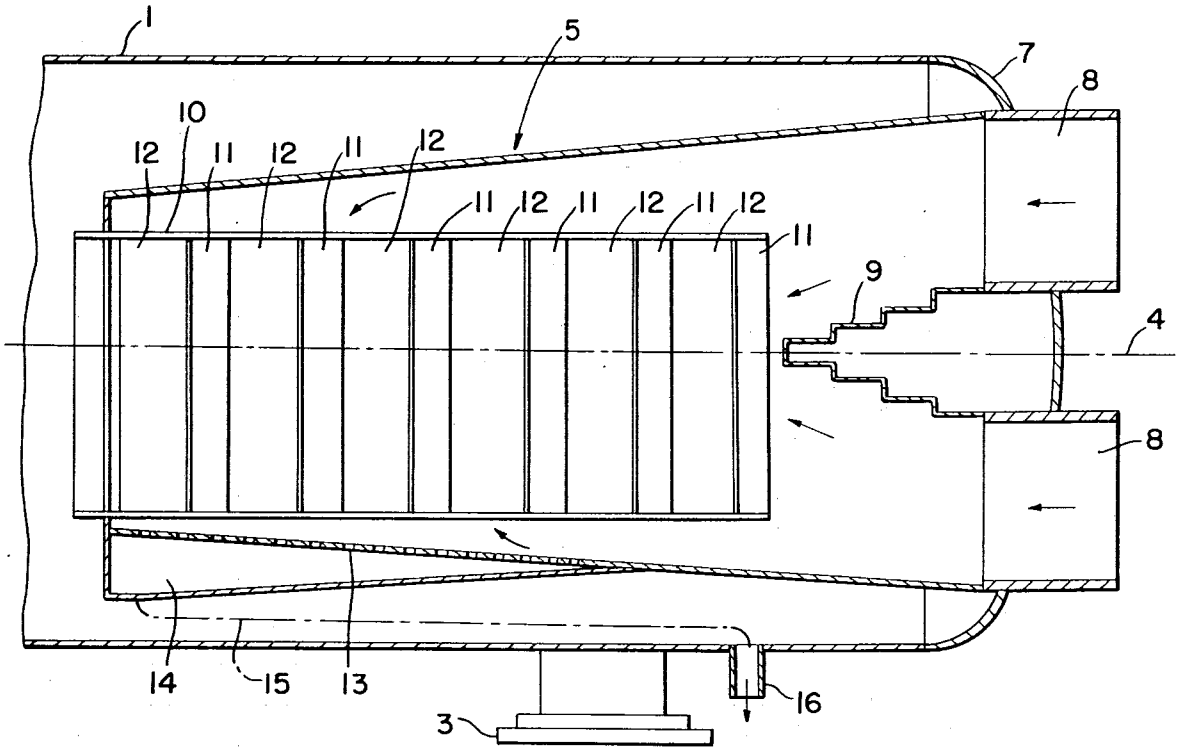
FIG. 2 is an enlarged view of the vertical longitudinal section of the water separator.
Figure 3:
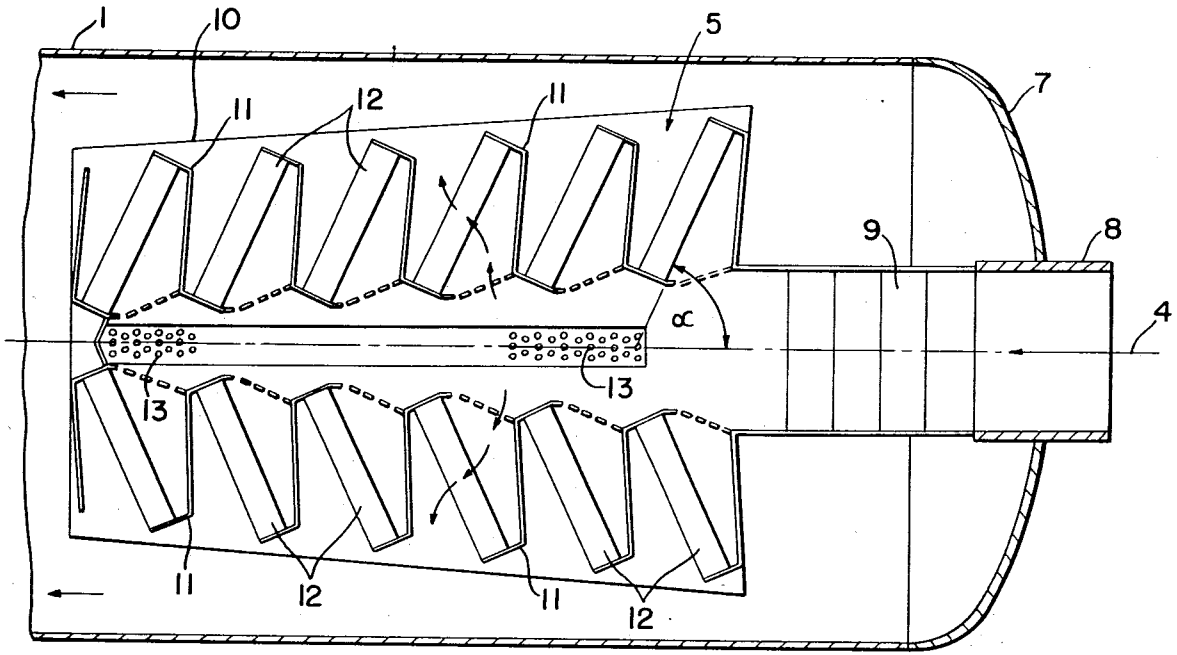
FIG 3 is an enlarged horizontal view of the longitudinal section of the water separator rotated by 90°.
Figure 5:
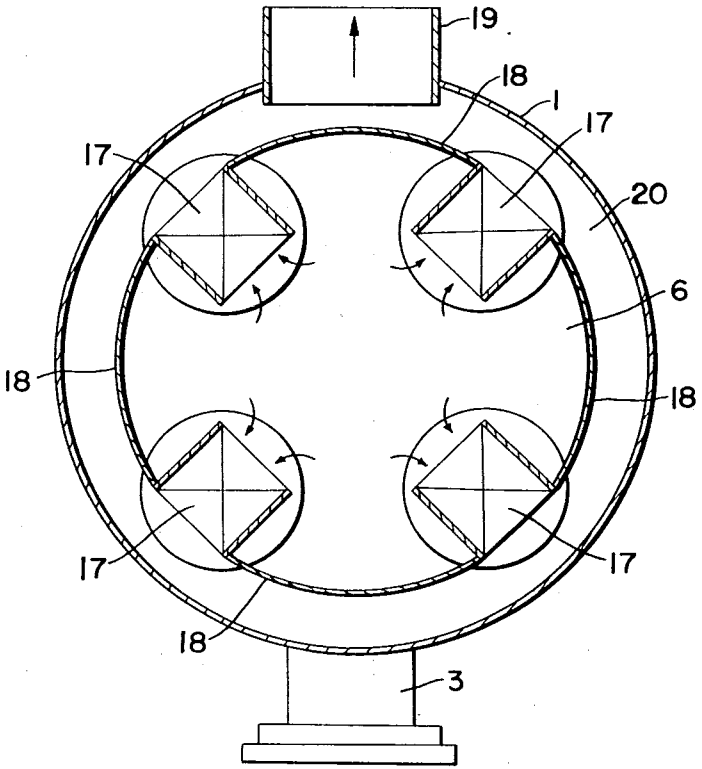
FIG. 5 is a cross-sectional view of the tank taken along line V—V in the vicinity of the tube bundles of the superheater.
Figure 4:
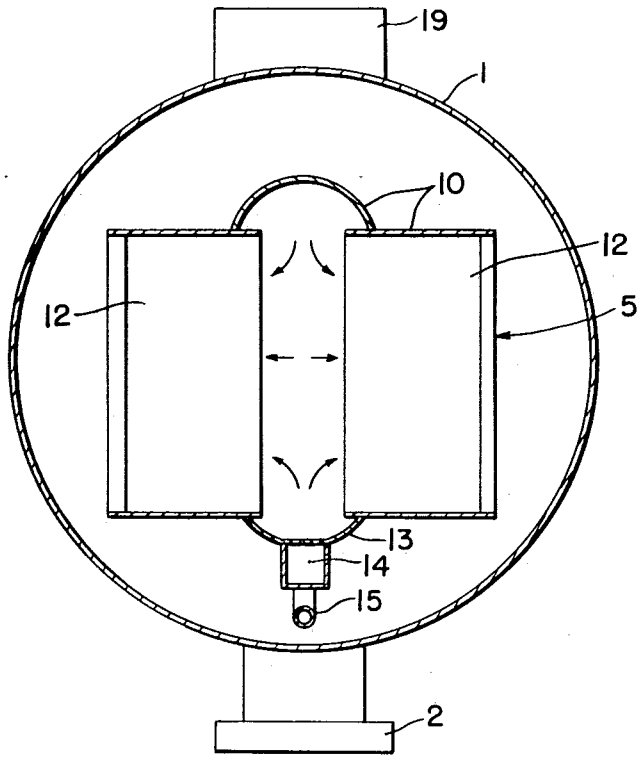
FIG. 4 is a cross-sectional view of the tank taken along line IV—IV in the vicinity of the water separator.

The vapor discharge surfaces of the bundles of laminations, within the truncated pyramid or cone construction of the water separator, are disposed symmetrically, vertically, and in tiers relative to the central axis of the tank, and are disposed at an angle of between 10 and 170° thereto.

With the present invention, there is made possible also to preliminarily separate splashed water from the wet vapor. A particular advantage in conjunction with the truncated pyramid or cone shape of the water separator is the uniform exposure of the individual bundles of laminations of the water separator. This avoids breakdown of the water separator, and a water jet formation at the outlet of the water separator which otherwise causes corrosive damage of unprotected iron-containing tank pressure walls. Due to the particular vapor guidance, only dry vapor arrives at the pressure walls of the tank. The speeds ahead of and after the water separator remain nearly constant, and pressure loss is reduced to a minimum. The structural solution pursuant to the present invention furthermore fulfills the present requirement for being able to inspect the inside of the tank pressure walls in an unrestricted manner.

DESCRIPTION OF PREFERRED EMBODIMENTS

Referring now to the drawings in detail, there is shown a horizontal, cylindrical tank pressure wall 1, which in the middle of the tank rests on a fixed support 2, and which at its two ends rests on sliding supports 3 to compensate for tank expansions caused by heat. A water separator 5 and a superheater 6 are disposed along the same central axis 4 of the tank.

Wet vapor inlets 8, which are located at the head end 7 of the tank, open into the water separator 5, which has a truncated pyramid or cone shape; the inlets 8 are provided with a diffusor-like guide arrangement 9. The water separator 5 furthermore comprises a housing 10, which in the illustrated embodiment has the shape of a truncated pyramid. To separate the water from the vapor, bundles of laminations 12 are disposed in the housing 10 in such a way that their vapor distribution surfaces are symmetrical, vertical, and in tiers relative to the central axis for the tank, and are preferably disposed at an angle $\alpha$ of 50 to 70° in such a way that the wet vapor, from the central axis 4 in the direction of the tank pressure walls 1, is guided by the housing 10 and connecting plates 11 in such a way that it flows uniformly horizontally through the bundles of laminations 12. If necessary, for example to conform to a certain speed of flow of the vapor, and/or for structural reasons, a different angle $\alpha$ of 10 to 170°, which deviates from the aforementioned range, and also a different orientation of the bundles, which deviates from a vertical orientation, can be utilized. Preferably, a separator device such as that disclosed in German Pat. No. 22 51 173 or in U.S. Pat. No. 3,950,156 Kall, dated Apr. 13, 1976 (which belongs to the assignee of the present invention) can be utilized for the bundles of laminations 12.

The water separated in the bundles of laminations is collected in the trough 14 via apertured plates 13 or other draining devices. From there, the water is withdrawn from the water separator 5 via the conduit 15, and is removed from the tank 1 via the outlet 16.

The superheater 6 follows the water separator 5 on the same central axis 4 of the tank. The heat exchanger tube bundles 17 of the superheater 6 are uniformly disposed along an imaginary circle about the tank axis 4, are nearly concentric, and are interconnected by plates 18. Dry vapor flows radially through the tube bundles 17 from the inside toward the outside. The superheated vapor thus passes into the annular chamber 20 located between the superheater 6 and the tank pressure wall 1, from where the superheated vapor leaves the tank 1 via the outlets 19. The outlets 19 for the superheated dry vapor can be variably located on the top cylindrical half of the tank pressure wall 1, thus permitting extensive adaptation to the vapor guidance in the tank. There is also possible to arrange the superheater tube bundles in a known manner in an imaginary square or rectangle in pairs, with the vapor flowing therethrough from the bottom to the top and also leaving the tank 1 through the outlets 19 via conically tapering vapor guidance plates.

The present invention is, or course, in no way restricted to the specific disclosure of the specification and drawings, but also encompasses any modifications within the scope of the appended claim.

What we claim is:

1. An arrangement containing a water separator for drying wet vapor, and a superheater for subsequently superheating the dried vapor; said arrangement including:

a horizontal, cylindrical tank having a central axis, at least one inlet for wet vapor, at least one outlet for superheated dry vapor, and at least one outlet for separated water;

a water separator disposed in said tank and, in the direction of said central tank axis, having the shape of a truncated pyramid or cone; said water separator being in communication with said at least one inlet for receiveing wet vapor therefrom; said water separator having improvement in combination therewith which comprises bundles of laminations arranged in pairs and in two rows extending in a horizontal plane substantially in the axis of the cylindrical tank as well as having vapor discharge surfaces that are disposed symmetrically, vertically, and in tiers relative to said central tank axis, and that are disposed at an angle generally in a range of from 10–170° preferably in a range of from 50–70° relative thereto; said at least one outlet for separated water being in communication with said bundles of laminations for receiving separated water therefrom;

a superheater disposed in said tank coaxially with said water separator and in communication therewith for receiving dried vapor therefrom; said superheater having improvement in combination therewith which comprises tube bundles which are uniformly disposed about said central tank axis and can vary in number and type of construction; said at least one outlet for superheated dry vapor being in communication with said tube bundles for receiving superheated dry vapor therefrom, said bundles of laminations being symmetrically arranged relative to the axis of the cylindrical tank with a distance spacing decreasing in a direction towards said superheater; and connecting plates located between said bundles of laminations and interconnecting said bundles of laminations for predetermined flow guidance therewith.

* * * * *